US011441561B2

(12) United States Patent
Borchers et al.

(10) Patent No.: US 11,441,561 B2
(45) Date of Patent: Sep. 13, 2022

(54) VANE PUMP

(71) Applicant: HANON SYSTEMS EFP DEUTSCHLAND GMBH, Bad Homburg v. d. Höhe (DE)

(72) Inventors: Dirk Borchers, Oberursel (DE); Thomas Dippel, Neustadt (DE); Rolf Popelka, Mörfelden-Walldorf (DE)

(73) Assignee: HANON SYSTEMS EFP DEUTSCHLAND GMBH, Bad Homburg v. d. Höhe (DE)

( * ) Notice: Subject to any disclaimer, the term of this patent is extended or adjusted under 35 U.S.C. 154(b) by 0 days.

(21) Appl. No.: 16/935,307

(22) Filed: Jul. 22, 2020

(65) Prior Publication Data

US 2021/0025387 A1 Jan. 28, 2021

(30) Foreign Application Priority Data

Jul. 26, 2019 (DE) ..... 1020191202906
Oct. 16, 2019 (DE) ..... 1020192159338

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/344*** | (2006.01) |
| ***F04C 15/00*** | (2006.01) |

(52) U.S. Cl.

CPC ..... *F04C 2/3446* (2013.01); *F04C 2/344* (2013.01); *F04C 15/0003* (2013.01); *F04C 2240/805* (2013.01)

(58) Field of Classification Search

CPC .... F04C 2/344; F04C 2/3446; F04C 15/0003; F04C 15/0023; F04C 2240/805; F04C 2230/60; F04C 2210/206

See application file for complete search history.

(56) References Cited

U.S. PATENT DOCUMENTS 4,207,038 A * 6/1980 Strikis ..... F04C 15/0023 418/133
4,505,655 A * 3/1985 Honaga ..... F04C 15/0023 418/133
6,641,380 B1 11/2003 Nied-Menninger et al.
8,579,613 B2 11/2013 Kobayashi et al.

(Continued)

FOREIGN PATENT DOCUMENTS

CN 104791245 A 7/2015
CN 106050647 A 10/2016

(Continued)

OTHER PUBLICATIONS

Office Action regarding German Patent Application No. 102019215933.8, dated Jul. 1, 2020.

(Continued)

*Primary Examiner* — Theresa Trieu

(74) *Attorney, Agent, or Firm* — Harness, Dickey & Pierce, P.L.C.

(57) ABSTRACT

A vane pump has a pump flange, a cam ring, a pressure plate and at least one pin extending axially through the pump flange, the cam ring and the pressure plate, the pin being preloaded in an axial direction thereof by means of at least one spring element.

3 Claims, 2 Drawing Sheets

(56) References Cited

U.S. PATENT DOCUMENTS

| | | | | |
|---|---|---|---|---|
| 2015/0204326 | A1* | 7/2015 | Tsukahara | F04C 14/223 418/24 |
| 2016/0305427 | A1 | 10/2016 | Welte | |
| 2016/0305428 | A1* | 10/2016 | Welte | F04C 15/0007 |

FOREIGN PATENT DOCUMENTS

| | | | | |
|---|---|---|---|---|
| CN | 109763893 | A | 5/2019 | |
| DE | 1505851 | A1 | 7/1970 | |
| DE | 2359279 | A1 | 6/1974 | |
| DE | 69800943 | T2 | 10/2001 | |
| DE | 102015017078 | A1 | 10/2016 | |
| DE | 102016204098 | A1 * | 9/2017 | F01C 21/108 |
| DE | 102015105928 | B4 * | 5/2018 | F01C 21/108 |
| JP | 52-132403 | A * | 11/1977 | F04C 14/26 |
| JP | 52132403 | A * | 11/1977 | F04C 15/02 |
| JP | S55096385 | A | 7/1980 | |
| JP | S59205032 | A | 11/1984 | |
| JP | 2006214520 | A | 8/2006 | |
| JP | 4026931 | B2 | 12/2007 | |
| JP | 2015137567 | A | 7/2015 | |
| JP | 5855358 | B2 | 2/2016 | |

OTHER PUBLICATIONS

Chinese Office Action regarding Chinese Application No. 202010709636.9, dated Dec. 29, 2021.

Japanese Office Action regarding Japanese Patent Application No. 2020121105, dated Feb. 8, 2022.

* cited by examiner

VANE PUMP

CROSS-REFERENCE TO RELATED APPLICATIONS

This application claims the benefit and priority of German Patent Application No. 102019120290.6, filed Jul. 26, 2019 and German Patent Application No. 102019215933.8, filed on Oct. 16, 2019. The entire disclosures of each of the above applications are incorporated herein by reference.

FIELD

The invention relates to a vane pump, which can be switchable and can be used as a transmission oil pump, which is preferably switchable.

BACKGROUND

The parts of such a pump must be mechanically preloaded in an axial direction to avoid gaps between the parts which lead to an embedding of the cam ring into the end plates during operation. The pump cartridge must also be held together for assembly, disassembly and transport to avoid gaps between the parts of the pump (the gaps are caused by the clearance of the parts as long as the parts are not pressed against each other).

In certain situations, insufficient installation space prohibits the use of existing solutions. Furthermore, the pump parts can sometimes not be pressed against each other for transport and handling using the shaft because of the special necessary pump design, such as a shaft end enclosed by the pressure plate.

A vane pump is shown in JP 4026931 B2 and has a pin (12 in FIG. 2).

During transport and handling, the pump can be tightened between the shaft end with a spring element on the side of the pressure plate and a shaft shoulder or another element at the flange side. Solutions without this tightening lead to undesired gaps between the parts during handling.

During operation, the spring element on the pressure plate is supported by the housing and thus generates the preload of the pump components.

Problems are embedding of the cam ring during operation and axial gaps between parts during pump handling. Moreover, when the pump is delivered as a pump cartridge or cartridge, without a housing, a previously used spring between the pump and the housing can no longer be employed in this manner.

SUMMARY

The above-mentioned problems are solved by an internal preload of the pump cartridge by means of one or more spring elements independent of the shaft and the housing. In other words, axial springs are used to preload and clamp the ring and the end plates together. However, the invention can be applicable to any type of pump, in which components thereof need to be preloaded, typically in an axial direction of the pump shaft. Preferably, the invention is currently used in a switchable vane pump essentially having two halves separated along the circumferential direction, which can separately be operated with the same or different pressures.

Previously, in the mounted condition, the pump cartridge was preloaded using a spring element supported on the pressure plate and in the housing. In the unassembled condition the cartridge parts are axially preloaded between pressure plate and flange with the shaft in combination with a spring element to compensate tolerances of the parts.

The invention now provides a solution for axial preloading of the cartridge under uninstalled and installed condition independent of the shaft and the housing, which is typically provided from the customer side, using pins through the pump in combination with spring elements preferably on the flange side of the pump.

The spring elements are on one side supported by the flange, on the other side by pins. These pins go through the flange and the cam ring. The pins are axially locked to the pressure plate (e.g. with a snap ring or a press fit). This generates the preload on the parts. Preferably, the pins also have the function of aligning the parts to each other (cam ring to flange and pressure plate to flange and cam ring). Moreover, the pins absorb transverse forces so that further advantages result with regard to handling as well as operation.

No components, such as the cup springs described below, have to be arranged in flow passages, e.g. the pressure plate, so that no or only very little flow loss occurs due to deflections, which would result in lower power. Furthermore, the installation space on the rear side of the pressure plate remains free for pressure kidneys, seals and similar components.

It is also possible to locate the spring elements on the side of the pressure plate. As regards the configuration of the spring element, a disc spring or cup spring has proven to be advantageous.

Thus, the invention is a space optimized solution that is independent of the shaft and the housing, which is typically provided from the customer side. Especially in such a situation, the invention provides the advantage of an axial preload which can advantageously be used during handling and transportation in order to avoid movements of the pump's components. In an efficient manner, the provided preload does not have to be changed in order to avoid gaps and its negative consequences during operation. Moreover, at the customer side, if the preload is already provided in the delivered cartridge, the customer's housing or any fasteners in its surroundings are advantageously not needed any longer for providing the preload for the pump. In particular, these advantages can be used in a configuration in which the end of the pump shaft is enclosed by the pressure plate.

Finally, it is advantageous for the reliability of the vane pump according to the invention if at least one pin is sealed by means of a soft seal.

DRAWINGS

DETAILED DESCRIPTION

Figure 1:
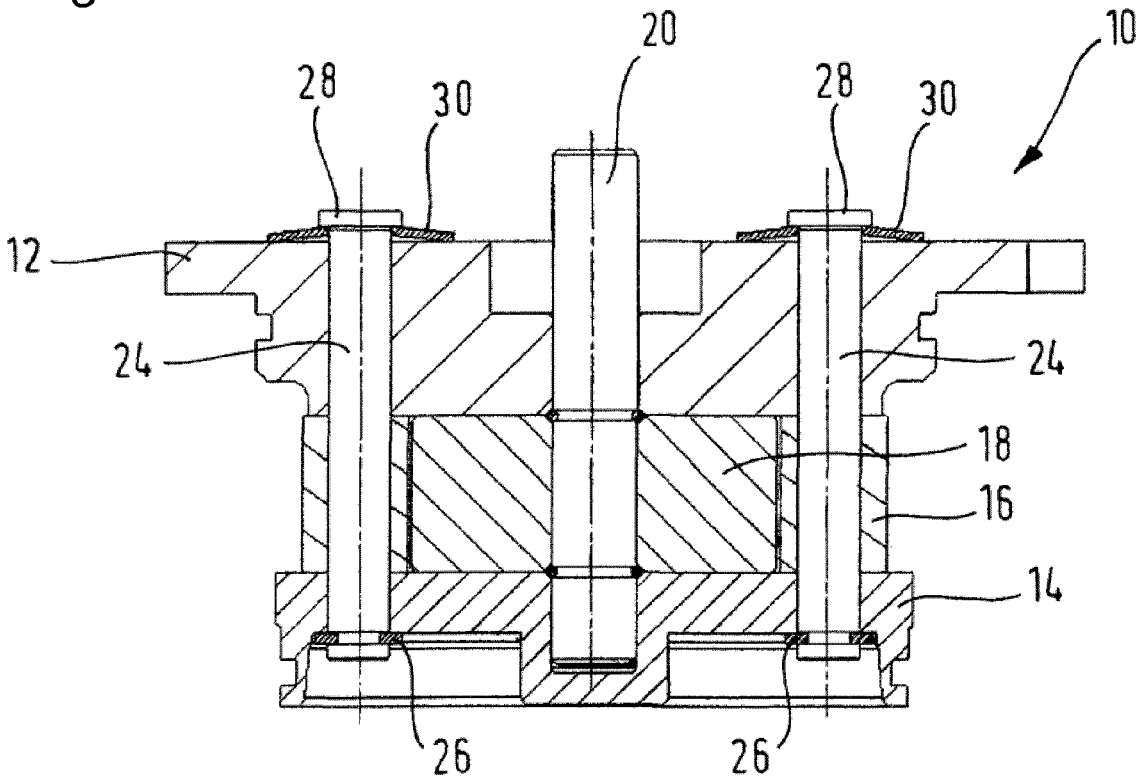
FIG. 1 shows a pump cartridge.

As can be seen in FIG. 1, the vane pump described herein is typically provided as a cartridge 10 comprising a flange 12, a pressure plate 14, a cam ring 16 and a rotor 18 having a shaft 20. The cartridge 10 is, in use, mounted to a housing (not shown), which is typically provided from the customer side. For example, the housing can be integrated into a transmission, in particular, the control unit or a partition plate thereof.

As can be seen in FIG. 1, in the embodiment shown, two pins 24 are provided axially, i.e. parallel to the shaft 20 and retained, in the case shown, at the side of the pressure plate, by means of snap rings or retainers 26. On the other side, i.e. at the side of the flange 12, the pins are provided with a pin flange 28 each, in order to clamp a disc spring 30 between the pin flange 28 and the pump flange 12. Since the springs 30 are clamped in a preloaded manner, the above-mentioned components of the pump are held together with preload, both for transport and handling and for operation.

Figure 2:
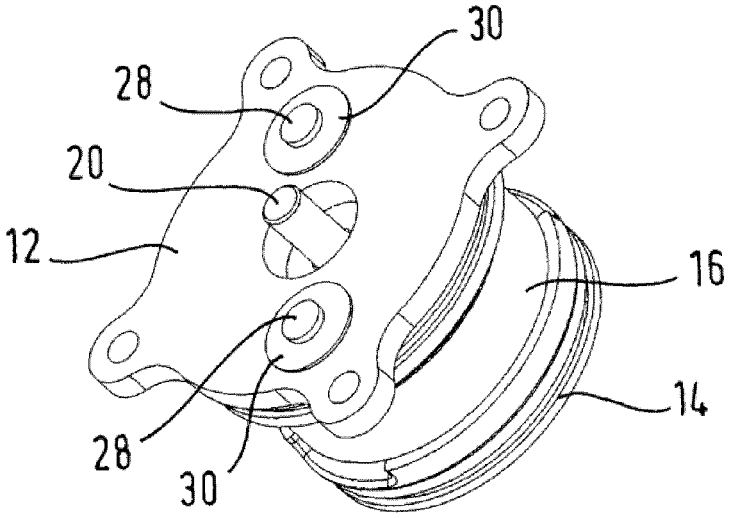
FIG. 2 shows a top perspective view of the pump cartridge shown in FIG. 1.

FIG. 2 additionally shows, in a perspective view from the side of the pump flange 12, the disc springs 30 and the end of the pump shaft 20.

Figure 3:
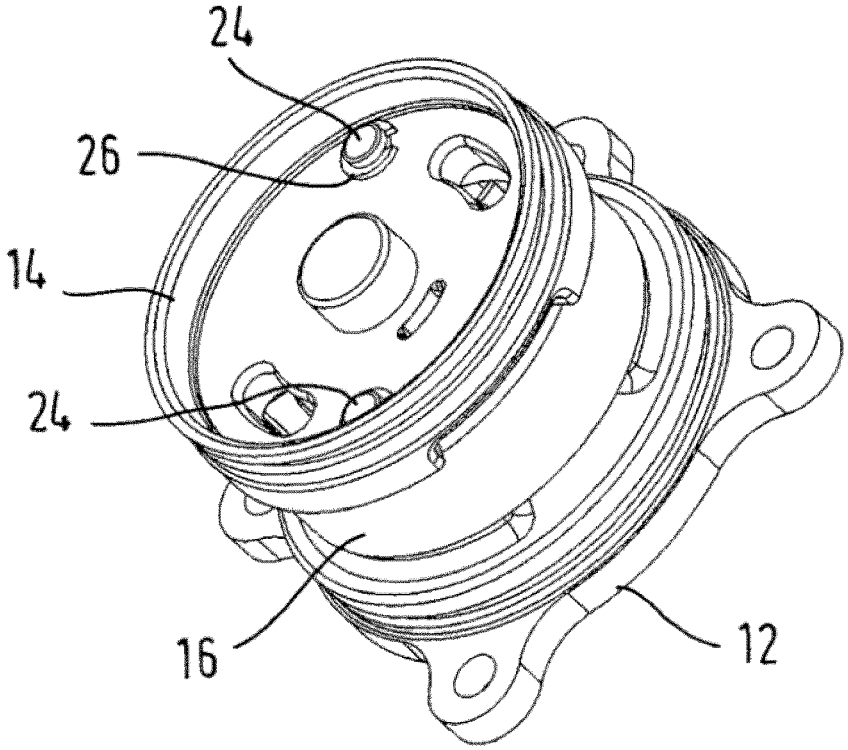
FIG. 3 shows a bottom perspective view of the pump cartridge shown in FIG. 1.

In FIG. 3, the side of the pressure plate 14 including the ends of the pins 24 locked by retainers 26 can be seen. It should be noted that the retainers 26 or any other means for locking the pins 24 can be provided at the side of the pump flange 12, and the disc springs 30 or any other suitable spring elements can be provided at the side of the pressure plate 14.

As can additionally be seen in FIG. 1, the end of the pump shaft 20 at the side of the pressure plate 14 is enclosed by pressure plate 14, in other words, accommodated in a recess thereof and does not extend through the pressure plate 14, so that it cannot be used for providing the necessary preload.

Figure 4:
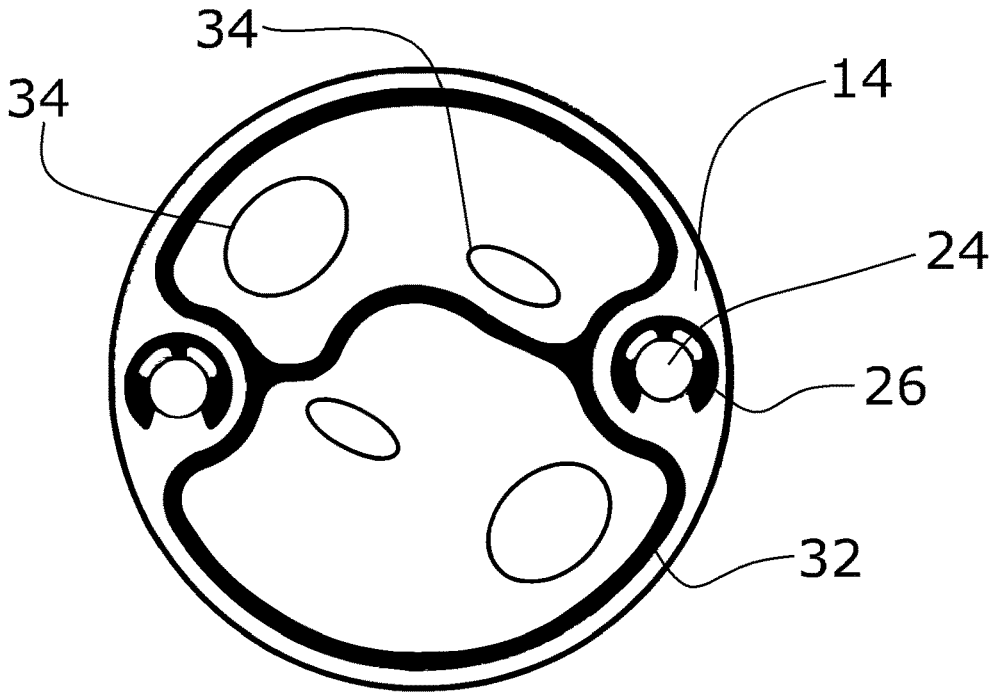
FIG. 4 shows a rear side of the pressure plate of a pump cartridge according to the invention.

In FIG. 4, the rear side of the pressure plate 14 including the end of the pins 24 and the retainers 26 provided therefor are illustrated. Moreover, a seal 32 and pressure kidneys 34 can be seen. Against the background that installation space is necessary for the seal 32 and the pressure kidneys 34, it is obvious that it is advantageous to provide the springs 30 at the side of the flange 12 so as to create the necessary installation space at the rear side shown in FIG. 4. As already stated above, the recognizable two halves of the seal 32 enclose two surfaces so that two pump halves can be operated at different pressures, which can be used e.g. in a switching pump.

What is claimed is:

1. A vane pump having a pump flange, a cam ring, a pressure plate as well as at least one pin extending axially through the pump flange, the cam ring and the pressure plate, the pin being preloaded in an axial direction thereof by at least one spring element, wherein the pin has a pin flange, and the spring element is disposed between the pin flange and the pump flange or, the spring element is on one side supported by the pin flange, and on the other side by the pump flange, the axial preload on the pin being based on the spring element being compressed between the pin flange and the pump flange, wherein the pressure plate includes a first side facing the cam ring and an opposite second side, the vane pump further including a retainer coupling the pin to the second side of the pressure plate to react the axial preload.

2. The vane pump according to claim 1, wherein the spring element is a disc spring or cup spring.

3. The vane pump according to claim 1, wherein one end of a pump shaft is enclosed by the pressure plate.

* * * * *